United States Patent [19]

Schmidt

[11] Patent Number: 4,490,995

[45] Date of Patent: Jan. 1, 1985

[54] RIGHT-LEFT KNITTED PILE FABRIC

[75] Inventor: Walter R. Schmidt, Krems, Austria

[73] Assignee: Teppichfabrik Karl Eybl Gesellschaft m.b.H., Vienna, Austria

[21] Appl. No.: 461,049

[22] Filed: Jan. 26, 1983

Related U.S. Application Data

[63] Continuation of Ser. No. 873,137, Jan. 27, 1978, abandoned.

[30] Foreign Application Priority Data

Jan. 31, 1977 [AT] Austria ..... 599/77

[51] Int. Cl.[3] ..... D04B 7/12

[52] U.S. Cl. ..... 66/191; 66/194

[58] Field of Search ..... 66/190, 191, 194, 202, 66/9 B

[56] References Cited

U.S. PATENT DOCUMENTS

| | | | |
|---|---|---|---|
| 353,652 | 11/1880 | Wrightson | 66/191 |
| 561,558 | 6/1896 | Bellis | 66/191 |
| 2,280,536 | 4/1942 | Moore | 66/191 |
| 2,985,001 | 5/1961 | Lamontagne et al. | 66/194 X |
| 3,021,698 | 2/1962 | Hill | 66/191 X |
| 3,023,596 | 3/1962 | Hill | 66/194 |
| 3,052,111 | 9/1962 | Howes | 66/191 |
| 3,226,952 | 1/1966 | Cassady | 66/9 B |
| 3,590,604 | 7/1971 | Bevcus et al. | 66/191 |
| 3,710,597 | 1/1973 | Schmidt | 66/191 |
| 3,894,409 | 7/1975 | Clingan et al. | 66/194 |
| 3,943,733 | 11/1976 | Wily | 66/190 |

FOREIGN PATENT DOCUMENTS

| | | | |
|---|---|---|---|
| 193423 | 3/1924 | United Kingdom | 66/190 |

*Primary Examiner*—Ronald Feldbaum

*Attorney, Agent, or Firm*—Karl W. Flocks; Sheridan Neimark; A. Fred Starobin

[57] ABSTRACT

A knitted base fabric comprises stitches which are arranged in courses and are formed each by a stitch-forming base yarn. A plurality of tufts are held on the base fabric by at least part of said stitches. Each of said stitches of at least one of said courses contains at least one filling yarn, which is held by said stitch and has an extensibility which is, at most, equal to the extensibility of the base yarn which forms said stitch. The total thread thickness of the filling yarns which are held by any one of said stitches exceeds a value which is slightly below the total thread thickness of the base yarn forming said stitch. Said filling yarns stabilize the fabric virtually in a predetermined useful width.

12 Claims, 7 Drawing Figures

RIGHT-LEFT KNITTED PILE FABRIC

This is a continuation of application Ser. No. 873,137, filed Jan. 27, 1978, now abandoned.

This invention relates to a knitted pile fabric which comprises pile tufts which are held by at least selected stitches and also comprises a base knitted fabric, each stitch of which is formed by a base yarn, and an additional filling yarn is held by stitches of predetermined courses of said base fabric, the stitch-forming first or base yarn and all additional yarns (filling threadlines) consisting of at least one thread each.

A knitted pile fabric is extensible in its longitudinal direction and particularly in its transverse direction, i.e., in the direction of its courses. Because this extensibility is excessively high for numerous uses, it is usual to adjust the fabric to a predetermined width and then to apply a finish to the rear side of the fabric. The extensibility in the transverse direction can be influenced by means of filling yarns which are tied into all or some courses.

It has been suggested, e.g., to introduce a filling yarn into courses of the base fabric of a pile fabric which is to be stitched or transferred to a garment and should simulate a natural for as closely as possible. That filling yarn should be introduced in such a manner that the resiliency of the knitted fabric, which may consist of stretch threads, is preserved. For this reason the filling yarn has a much higher elasticity than the base yarn of the base fabric so that the filling yarn merely increases the elastic restoring force of the base fabric without reducing its elasticity.

In webs consisting of a knitted base fabric and loose pile fibers it is known to knit a U-shaped pile tuft into a stitch of a course and to bridge said course with the two legs of the tuft, which legs are of equal length and are tied into the adjacent stitches of the course which is knitted next. In order to hold the knitted fabric together in its transverse direction, filling yarns are tied in predetermined courses and stitches between the first and second tying points of the pile tufts, which are held in twice. The useful width and the extensibility in width of these fabrics are not defined by these filling yarns but are defined by a more or less through filling of the fabric which may be tubular or cut open and is covered with pile fibers on both sides.

It is an object of the invention to provide a pile fabric which distingishes by a lower extensibility, particularly in its transverse direction, without using base yarns which are thicker than usual, and which also distinguishes by a denser base fabric. It is also desired to enable to provision of a pattern in the fabric by the provision of untufted regions.

This object can be accomplished by the provision of a pile fabric which has the structure defined first hereinbefore and in which, in accordance with the invention, at least one of the filling yarns that is tied in a course has an extensibility not in excess of the extensibility of the base yarns, the total yarn thickness of the filling yarns tied into a course is above a predetermined lower limit and is equal to or only slightly smaller than the total yarn thickness of the base yarn, and the filling threadlines stabilize the fabric virtually in a predetermined useful width. The pile fabric according to the invention has virtually its useful width as it is removed from the machine and preserves that useful width but is not entirely inextensible in its transverse direction. A finish may be applied but is not necessary. It has been found that the provision of the filling yarn results in a higher density of the base fabric even at untufted stitches. For this reason, tufted and untufted stitches may be arranged in a pattern in part of the area of the fabric or throughout the area of the fabric so that a patterned fabric is obtained. Specifically, the filling yarn may impart such a high density to the fabric at the untufted stitches the visibility of the base yarn on the left side of the fabric is decreased. The resulting higher density results in a more uniform distribution of the residual extensibility and of the appearance of untufted stitches to such an extent that the presence of course portions consisting only of untufted stitches will not result in intolerable changes in extensibility of appearance. In a preferred arrangement, which results in a great increase in density and a high uniformity, the filling base yarn is held over the needle loop in one stitch and under the needle loop in an adjacent stitch of the same course. The same result can be produced in that the filling yarn is introduced over the needle bend of one stitch and under the needle loop of an adjacent stitch of the same wale.

The filling yarns which are tied into the base fabric improve also the tying of the pile tufts so that the fiber crimp can be polished. The fabric may intentionally comprise pile tufts of at least two different kinds, such as tufts made from different fibers, tufts made from fibers differing in length and tufts made from fibers differing in color. The possibility to provide the fabric according to the invention with a pattern is greatly increased in this way.

The base fabric of the fabric according to the invention may also comprise courses in which different stitch-forming yarns are used in adjacent zones. In this case the yarns are equal in number to the zones and in the structure of the base fabric are equivalent in that each yarn forms the stitches in one zone, in which the other yarns serve as filling yarns to increase the density of the fabric. Because only one course is involved in each case, the portions and zones are linear. In adjacent courses, which have been knitted in succession, such linear zones may overlap so that the fabric comprises regions which may be arranged in a pattern. The fabric according to the invention may comprise courses which are divided into portions or zones and may include areas which are divided into portions and zones. In the latter case, the division into portions and the division into zones are mutually independent although one division may be incorporated in or identical to the other. Specifically, a zone may be provided with pile tufts so that it constitutes also a portion. The use of at least two yarns which in alternating portions constitute a stitch-forming base yarn and a filling yarn enables an interesting modification because the threadlines need not have the same total thread thickness. In general, the tufted stitches are desirably knitted from a threadline which has a relatively small thread thickness so that pile tufts which are large in cross-section can be tied in. For this reason, in a pile fabric according to the invention comprising a base fabric made from yarns having different total thread thicknesses, it is desirable to form the stitches of a tufted zone from a yarn having a smaller total thread thickness and to form the stitches of the untufted zones from a yarn having a larger total thread thickness.

A known knitted pile fabric comprises a base fabric consisting of fibrillated yarn, which consists of synthetic thermoplastic material and is thermoset when it has been knitted so that the need for a finishing of the fabric is eliminated. In the knitted pile fabric according to the invention at least one of the yarns forming the fabric may also consist at least in part of a low-melting thermoplastic material, such as a synthetic polymer, and that yarn may be fused completely or in part to tie in the pile tufts with virtually invisible joints.

Illustrative embodiments of the invention will now be explained more fully with reference to the accompanying drawings, in which FIGS. 1 to 4 are stitch pattern diagrams of respective knitted fabrics, each of which comprises a base yarn and a filling yarn, which is introduced in different ways.

Figure 1:
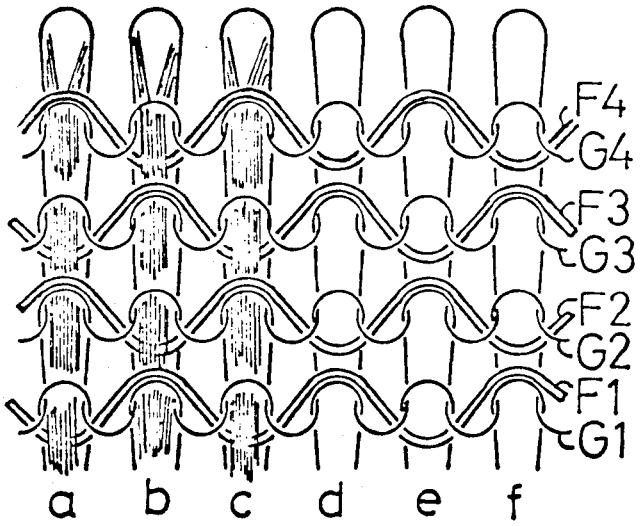

The pile fabric according to the invention which is shown in FIG. 1 comprises stitches which are formed by a base yarn that is designated $G_1$, $G_2$, $G_3$, $G_4$ in courses which have been knitted in succession. Stitches which are aligned in a direction which is normal to the direction of the courses form wales, a, b, c, d, e, f. It is apparent that pile tufts are not providee in all stitches but are provided only in the stitches of wales a, b, c and that these pile tufts are tied into the needle stitches. That portion of the fabric which is represented by the stitch pattern diagram has in each course two adjoining portions which consist of three wales each and which together with corresponding portions of adjacent courses form regions of the fabric. Of these portions of each course, only the portion d, e, f contains only untufted stitches. It will be understood that the specific division which has been shown is by no means essential. The tufted portions in each course need not extend as far as to one and the same wale and it is not necessary to provide tufted stitches in all courses. It is apparent that the division into portions may be selected in various ways so that pile fabrics having numerous different patterns may be provided. All courses include a filling yarn, which has portions designated $F_1$, $F_2$, $F_3$, $F_4$ in respective courses which have been formed in succession. In this embodiment, the total thread thickness of said filling yarn exceeds the total thread thickness of the base yarn. The filling yarn is tied in alternating stitches of the courses and of the wales. In the lowermost course, those sinker loops of the base yarn $G_1$ which joints the needle wales tie in the filling threadline $F_1$, which lies in the needle loops of wales b, d, and f as a tuck loop and in the needle loops of wales a, c and e as a float. In the needle loops of wales a and c, these floats force the pile fibers which have been knitted with the base yarn $G_1$ against the upper needle loop of the previously formed course so that the pile is held more strongly by these stitches. It is also apparent that the filling yarn $F_1$ reinforces the sinker stitches formed by the base yarn $G_1$ and thus stabilizes the fabric. Because the filling yarn $F_1$ is much thicker than the base yarn $G_1$, the wales d, e., and f are also denser and no longer seem to be transparent.

In the next upper course formed by the base yarn $G_2$, the filling yarn $F_2$ is held by the sinker loops to form, in the embodiment shown, tuck loops in the needle loops of those wales in which the filling yarn $F_1$ forms floats in the first course.

Figure 2:
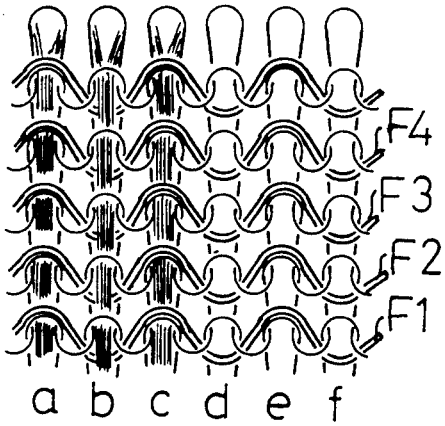
Figure 3:
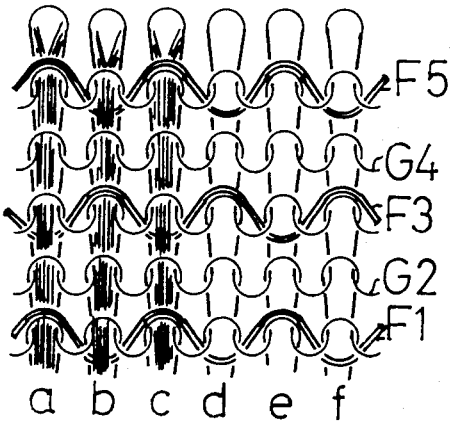
Figure 4:
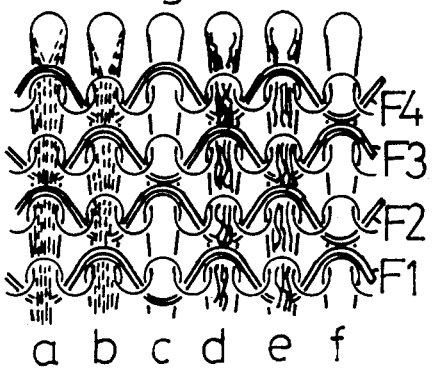
Figure 5:
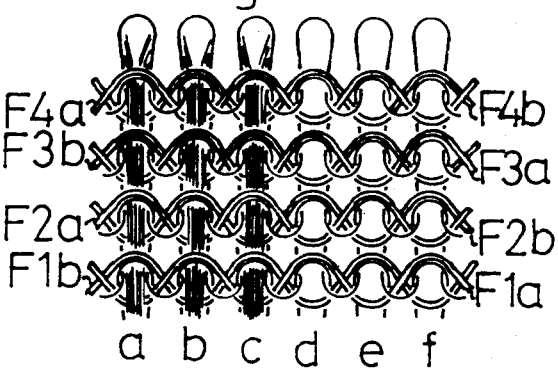
FIG. 5 is a stitch pattern diagram of a fabric which has two filling yarns per course.

The stitch pattern diagram shown in FIG. 2 represents substantially the same structure as FIG. 1 but the filling yarns $F_1$, $F_2$, $F_3$, and $F_4$ always lie in the same wale on and under the needle loops, respectively. The filling yarns may alternatively be tied in alternate courses or in courses arranged in larger intervals and may always lie on the upper needle loop in the same wale or in wales which are offset as desired. In accordance with FIG. 3, filling yarns are inserted in alternate courses and lie on needle loops which are staggered in alternation. In the fabric shown in FIG. 4, the filling yarn is arranged as in FIG. 1 but pile tufts of a first kind in respect of color, material composition, fiber thickness or fiber length are tied in wales a and b, pile tufts of a second kind are tied in wales d, e, and the stitches of wales c and f are untufted. The arrangement and number of different pile tufts may differ from the fabric shown when it is desired to form a predetermined pattern. FIG. 5 is a stitch pattern diagram of a fabric in which two filling yarns are tied in each course, namely, filling yarns $F_1$a and $F_1$b in the first course, filling yarns $F_2$a and $F_2$b in the second course, etc. This results in a particularly dense base fabric having a restricted extensibility.

Figure 6:
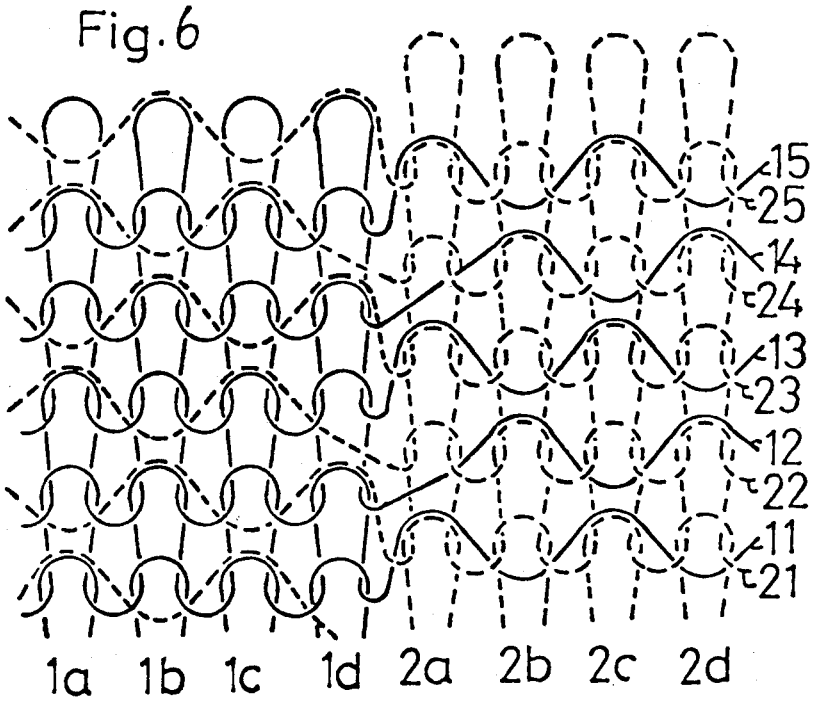
FIG. 6 is a stitch pattern diagram showing a fabric having yarns which have base and filling portions in alternation.
Figure 7:
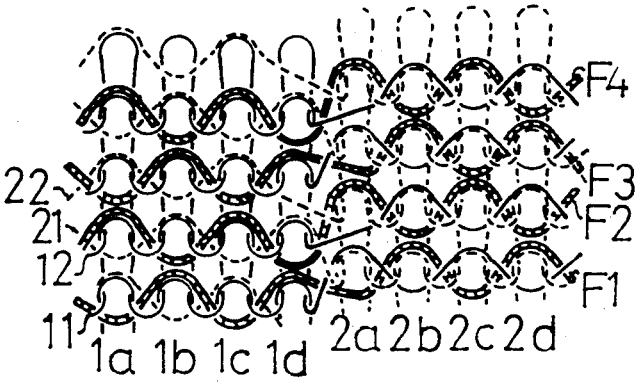
FIG. 7 is a stitch pattern representation showing such fabric which has an additional filling yarn per course.

In the embodiments described hereinbefore, the stitches are formed by a base yarn which serves only that purpose and the density of the fabric is increased only by at least one separate filling yarn. The embodiments shown in FIGS. 6 and 7 are different in that they comprise two yarns and the fabric comprises two adjacent regions, in one of which the first yarn is used to form the stitches and the second yarn is used to increase the density of the fabric whereas in the other zone the second yarn is used to form the stitches and the first yarn is used to increase the density of the fabric. FIG. 6 is a stitch pattern diagram showing five courses, which have been knitted in succession from bottom to top, and eight wales 1*a*, 1*b*, 1*c*, 1*d* and 2*a*, 2*b*, 2*c*, 2*d*. In that region of the fabric which consists of wales 1*a* to 1*d*, the stitches are formed by a yarn that is represented by a solid line and designated 11, 12, 13, 14, 15 in respective courses. A second is represented by a dotted line and designated 21, 22, 23, 24, 25 and serves in that region as a filling yarn. In the adjacent region, which consists of wales 2*a* to 2*d*, the stitches are formed by the yarn represented by a dotted line and the filling yarn consists of the threadline indicated by a solid line. Pile tufts have not been shown, for the sake of clearness. Such pile tufts may be tied in all or in selected stitches of one region or of each region, as has been described. It is repeated that the base fabric may have courses consisting of more than two zones and in accordance therewith may be composed of a corresponding number of yarns, which form the stitches in respective zones whereas the remaining yarns are tied in each zone as filling yarns.

In this embodiment, each zone of each course contains all yarns, one of which serves as a stitch-forming base yarn and the other serve as filling yarns.

Additional filling yarns may be used. FIG. 7 shows a pile fabric which includes an additional filling yarn, which is designated $F_1$ to $F_4$ in the successive courses and which is tied in accordance with FIG. 4. It is noted that the alternate tying of the filling yarn at the boundaries between the regions of the fabric may be effected not only in the manner shown in FIGS. 6 and 7 but also in any other manner which is known from loop-sinking technology. The divisions of the fabric area into zones and portions of courses highly independent from each other, as has been mentioned before, although the zones and portions may form elemental areas of a common pattern.

From the foregoing and from the drawings it is apparent that the pile fabric according to the invention has an increased density throughout its area and that this has been accomplished in an extremely simple manner, and that the extensibility of the fabric is restricted to a predetermined extend and is highly uniform so that a pattern of elemental areas, which include untufted regions, may be provided. Even in such untufted regions, the fabric is so dense that it does not appear to be thin and is not transparent in such regions. In general it is sufficient to use filling yarns which have virtually the same total yarn thickness as the stitch-forming base yarn, and the total yarn thickness of filling yarns which do not form stitches may greatly exceed said lower limit and may be selected in dependence on the requirements in each case.

The fabric may be finished on its rear side, e.g., when this is desired by the customer, although such finish is not necessary at all. This fact opens up an advantageous possibility. If the base fabric contains at least one yarn which consists entirely or in part from a low-melting synthetic thermoplastic, such as polyethylene, and the pile tufts are additionally tied in by said yarn in that said yarn is fused at least in part, a nap can be raised on the fabric in that part of the pile fibers are pulled through the fabric from its left-hand to its right-hand side.

In general the threads of yarns consisting of two or more threads are substantially parallel or are joined together, e.g., by twisting.

What is claimed is:

1. A plain-knit pile fabric comprising at least one first fabric region of mutually interlocked first yarn loops forming courses and wales, said first fabric region including in a coursewise pattern repeat of plurality of walewise bands of pile tufts tied in said first yarn loops to form tufted zones in said first fabric region, and further including in a walewise pattern repeat a plurality of second-yarn loops forming courses of floats and tucks with alternate wales wherein the second-yarn is tied in the first-yarn needle loops of first alternate wales as a tuck loop and lies in the first-yarn needle loops of second alternate wales as a float.

2. The fabric of claim 1, wherein said tufted zones alternate with untufted zones comprising first-yarn loops forming wales without pile tufts.

3. The fabric of claim 1, wherein said second yarn has a total thread thickness at least equivalent to the thread thickness of the first yarn and an extensibility no greater than that of the first yarn.

4. The fabric of claim 1, wherein adjacent courses of the second yarn are the same in each walewise pattern repeat.

5. The fabric of claim 1, wherein adjacent courses of the second yarn form alternate tucks and loops in each walewise pattern repeat.

6. The fabric of claim 1, wherein the second-yarn is tied in alternating courses of first-yarn needle loops.

7. The fabric of claim 1, wherein the second-yarn is tied in each course of first-yarn needle loops.

8. The fabric of claim 1, wherein at least two tufted zones are formed from different pile fibers.

9. The fabric of claim 1, further including a plurality of third-yarn loops in a walewise pattern forming courses of floats and trucks, each third-yarn loop alternating with the floats and tucks formed by the second-yarn loops.

10. The fabric of claim 1, further including at least one second fabric region of mutually interlocked second-yarn loops forming courses and wales, said second fabric region including in a coursewise pattern repeat a plurality of walewise bands of pile tufts in said second-yarn loops to form tufted zones in said second fabric region and further including in a walewise pattern repeat a plurality of first-yarn loops forming courses of floats and tucks with alternate wales wherein the first-yarn is tied in the second-yarn needle loops of alternating wales as a tuck loop and lies in the first-yarn needle loops of second alternate wales as a float.

11. The fabric of claim 10, further including a plurality of third-yarn loops in a walewise pattern in said regions forming courses of floats and tucks, each third-yarn loop alternating with the floats and tucks formed by the first or second-yarn loops in each region.

12. The fabric of claim 11, wherein at least some of the yarn is formed from a thermoplastic.

* * * * *